United States Patent [19]

Kottas

[11] Patent Number: 4,706,416

[45] Date of Patent: Nov. 17, 1987

[54] TOOL FOR REMOVING RESIDUES

[76] Inventor: Robert P. Kottas, 711 North 91st Plaza, #304 Omaha, Nebr. 68114-2645

[21] Appl. No.: 2,443

[22] Filed: Jan. 12, 1987

[51] Int. Cl.[4] ..... B24B 23/00

[52] U.S. Cl. ..... 51/170 T; 51/209 R; 29/76 A

[58] Field of Search ..... 51/170 R, 170 TL, 170 MT, 51/204, 209; 29/76 A, 76 R, 78, 81 L

[56] References Cited

U.S. PATENT DOCUMENTS

| | | | |
|---|---|---|---|
| 1,290,990 | 1/1919 | Hickey | 51/209 R |
| 2,413,452 | 12/1946 | Kaiser | 51/209 R |
| 2,442,129 | 5/1948 | Hollstrom | 51/209 R |
| 3,318,053 | 5/1957 | Miller | 51/209 R |
| 3,464,166 | 9/1969 | Bouvier | 51/209 R |

*Primary Examiner*—Roscoe V. Parker
*Attorney, Agent, or Firm*—Henderson & Sturm

[57] ABSTRACT

A tool for removing residues including a vibrating base and a number of cutters attached to the base. Each cutter includes a foot portion defining the lower portion of the cutter. The perimeter of the foot portion carries a cutting edge which contacts and removes residues from a work surface. The cutters are removably mounted on the base so that they can be interchanged with cutters including foot portions having perimeters of various geometric shapes. Further, the cutters are mounted on the base such that the inclination angle of the cutters can be adjusted with respect to the base. Changing the geometric shape and inclination angle of the cutters adjusts the abrasive action of the tool.

18 Claims, 7 Drawing Figures

TOOL FOR REMOVING RESIDUES

TECHNICAL FIELD

This invention relates to tools, and more particularly to a tool for removing residues such as wax, paint or dirt from a surface.

BACKGROUND ART

Although various tools are available for removing residues, all have shortcomings, such as lack of utility, flexibility and durability.

Those concerned with these and other problems recognize the need for an improved tool for removing residues.

DISCLOSURE OF THE INVENTION

The present invention provides a tool for removing residues including a vibrating base and a number of cutters attached to the base. Each cutter includes a foot portion defining the lower portion of the cutter. The perimeter of the foot portion carries a cutting edge which contacts and removes residues from a work surface. The cutters are removably mounted on the base so that they can be interchanged with cutters including foot portions having perimeters of various geometric shapes. Further, the cutters are mounted on the base such that the inclination angle of the cutters can be adjusted with respect to the base. Changing the geometric shape and inclination angle of the cutters adjusts the abrasive action of the tool.

An object of the present invention is the provision of an improved tool for removing residues from a surface.

Another object of the present invention is to provide a tool for removing residues that is easy to use.

A further object of the present invention is the provision of a tool for removing residues that is useful in removing a variety of residues.

Still another object of the present invention is to provide a tool for removing residues that is simple in structure and easy to maintain.

A still further object of the present invention is the provision of a tool for removing residues that is durable.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
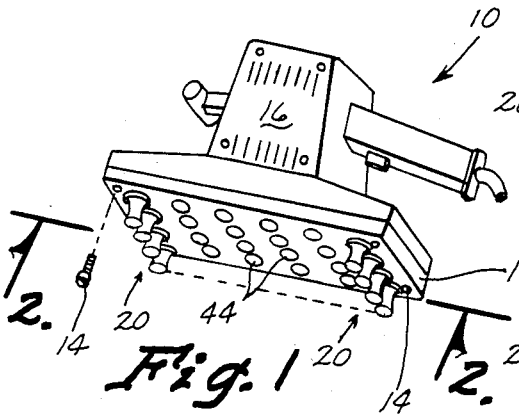
FIG. 1 is a perspective view of the tool of the present invention having a number of cutters removed from the base to clearly illustrate the structure.
Figure 2:
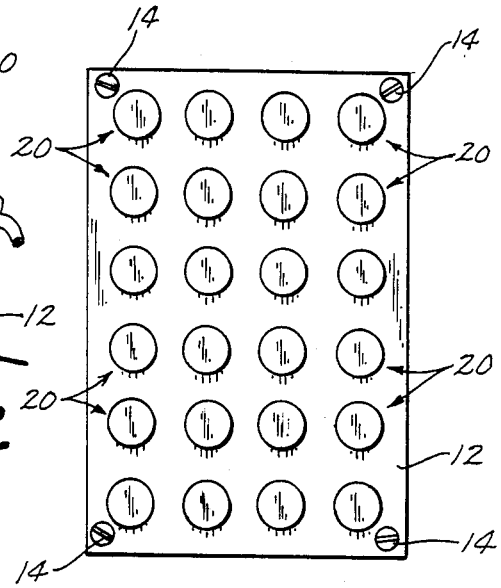
FIG. 2 is an enlarged bottom plane view taken along line 2—2 of FIG. 1.

Referring now to the drawings, wherein like reference numerals designate identical or corresponding parts throughout the several views, FIG. 1 shows the tool (10) of the present invention including a base (12) attached by fasteners (14) to a vibrating device (16) such as a conventional vibrating sander. A number of cutters (20) are mounted on the base (12) in a regular pattern as illustrated in FIG. 2. It is to be understood that the number of cutters (20) and the pattern can be varied to suit the application.

Figure 3:
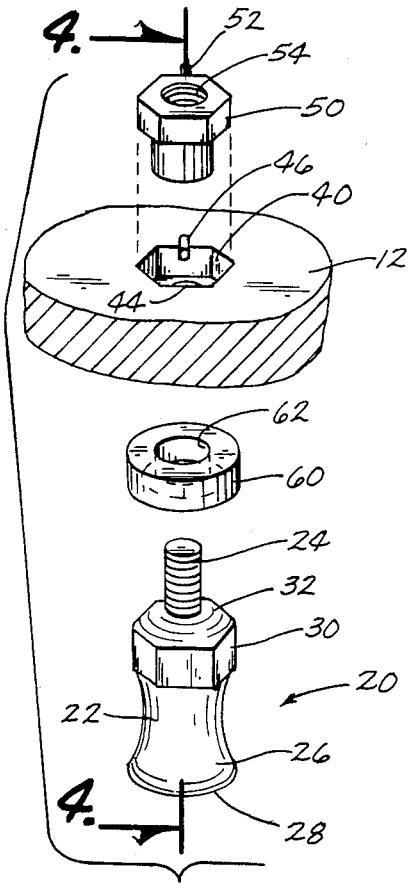
FIG. 3 is a greatly enlarged exploded perspective view illustrating the structure for mounting a cutter to the base.
Figure 4:
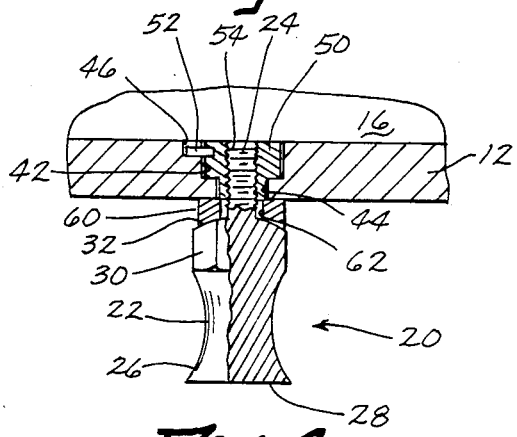
FIG. 4 is a sectional view taken along line 4—4 of FIG. 3 showing an insert having a threaded opening disposed perpendicular to the base.
Figure 5:
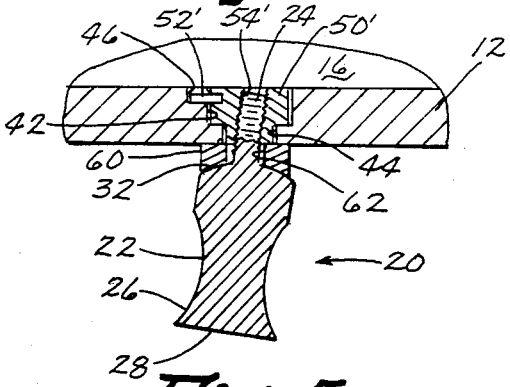
FIG. 5 is a sectional view similar to FIG. 4, but showing an alternate insert having a threaded opening that is disposed at an oblique angle with respect to the base.

As best shown in FIGS. 3–5, each cutter (20) includes a body (22) having an upper portion forming a threaded stud (24) and a foot portion (26) having a cutting edge (28) at the perimeter thereof. The cutter (20) carries a hexagonal surface (30) and a spherical segment (32) below the stud (24).

Figure 6:
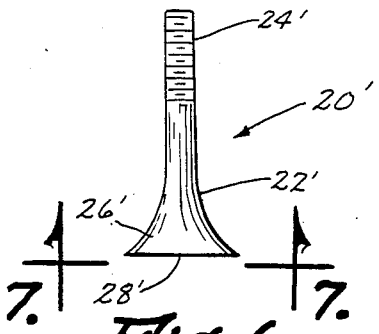
FIG. 6 is a side elevational view of an alternate valve-shaped cutter structure differing from that shown in FIGS. 3–5.
Figure 7:
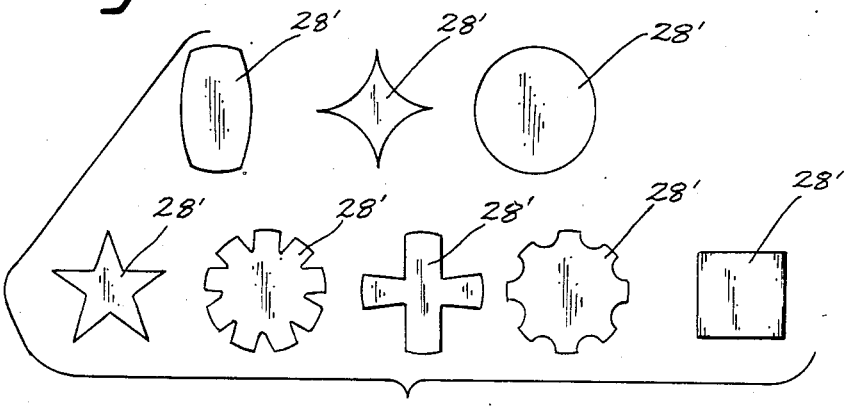
FIG. 7 is a bottom plan view taken along line 7—7 of FIG. 6 illustrating some of the possible geometric shapes of the cutting edge at the perimeter of the foot portion of the cutter.

FIG. 6 illustrates an aternate valve-shaped cutter (20') including a body (22') with a threaded stud (24') and a foot (26') having a cutting edge (28') at the perimeter. FIG. 7 shows some of the many possible geometric shapes of the cutting edge (28') that could be incorporated in the present invention. In general, the shapes having more angled or curved side sections are more abrasive than those having fewer connected sections.

Referring again to FIGS. 3 and 4, it can be seen that the base (12) includes a number of apertures (40) having a hexagonal recess (42) and a restricted circular bore (44). A keyway (46) extends out from one side of the hexagonal recess (42). A first insert (50) and an outwardly extending key (52) are matingly received in the aperture (40) and keyway (46), respectively. Since the key (52) is required to assure angle orientation, it is not required on an insert with a perpendicular angle. The first insert (50) includes a first threaded opening (54) disposed at a first angle with respect to the base (12). A washer (60) is interposed between the base (12) and the cutter (20) and the opening (62) is sized larger than the stud (24). Orientation of the inserts (50 and 50') may in some cases be non-uniform. For example, some applications may necessitate pointing each of the cutters (20) toward the outside edge; or a specialized application could use angled inserts (50') around the edge with perpendicular inserts (50) in the interior. (The interior cutters (20) would require a longer body (22) to maintain surface contact.)

FIG. 5 shows a second insert (50') and an outwardly extending key (52') received in aperture (40) and keyway (46), respectively. The second insert (50') includes a second threaded opening (54') disposed at a second angle with respect to the base (12). The large opening (62) in washer (60) provides clearance for the threaded stud (24) when the cutter (20) is attached at an oblique angle with respect to the base (12).

The tool (10) of the present invention is useful in removing wax, paint, dirt or other residues from a surface. Although described herein as a base (12) attached to a conventional vibrating sander (16), it could also be fabricated to include a self-contained vibration device (16). The number, size, shape, and inclination angle of the cutters (20) may be varied depending upon the residue material, the residue thickness and numerous physical differences in the residue and the surface from which the residue is to be removed.

In operation, if a 90° angle of inclination is desired, the base (12) is removed and the first insert (50) is secured in each of the apertures (40). The base (12) is then reattached by fasteners (14) and cutters (20) of the desired size and shape are threaded into the first threaded openings (54) and tightened by a conventional wrench in engagement with the hexagonal surface (30). If cutters (20) of a different size or shape are desired, one cutter (20) is simply detached and replaced by another.

If the angle of inclination is to be changed, the base (12) is removed from the vibrating unit (16), all cutters (20) are detached, all first inserts (50) are removed, and second inserts (50') are inserted. The base (12) is then reattached to the vibrating unit (16) and the desired cutters (20) are threaded into the second threaded openings (54') and tightened. It is understood that numerous inclination angles could be provided by providing inserts with threaded openings of the desired inclination.

Thus, it can be seen that at least all of the stated objectives have been achieved.

Obviously, many modifications and variations of the present invention are possible in light of the above teachings. It is therefore to be understood that, within the scope of the appended claims, the invention may be practised otherwise than as specifically described.

I claim:

1. A tool for removing residues from a surface comprising:

a base;

means for vibrating said base;

a plurality of cutters mounted on said base, said cutters being disposed to contact said surface, each of said cutters including a body having an upper portion mounted to said base and a foot portion at the lower end of said cutter, said foot portion including a cutting edge at the perimeter thereof; and means for adjusting the angle of inclination of said cutters with respect to said base.

2. The tool of claim 1 wherein the cutters are mounted on said base in a pattern wherein the perimeter of each cutter is spaced from the perimeters of adjacent cutters.

3. The tool of claim 1 wherein said cutters are removably mounted on said base.

4. The tool of claim 3 wherein said base includes a plurality of apertures, each aperture disposed to receive the upper portion of one of said cutters.

5. The tool of claim 4 wherein said upper portion of each of said cutters carries a threaded stud and wherein said angle adjusting means includes:

a plurality of first inserts, each adapted to be removably secured within the apertures in said base, each first insert including a threaded opening to receive said stud and being disposed at a first angle with respect to said base; and a plurality of second inserts each adapted to be removably secured within the apertures in said base when said first inserts are removed, each second insert including a threaded opening to receive said stud and being disposed at a second angle with respect to said base.

6. The tool of claim 5 wherein said aperture in said base is multi-sided and includes a keyway formed in one side, and wherein said first inserts include a key projection adapted to matingly engage said keyway, whereby the orientation of said first inserts with respect to said base will be uniform.

7. The tool of claim 6 wherein said second inserts include a key projection adapted to matingly engage said keyway.

8. The tool of claim 1 wherein the perimeter of said cutters is regularly shaped.

9. The tool of claim 8 wherein the perimeter of said cutters is circular.

10. The tool of claim 8 wherein the perimeter of said cutters is rectangular.

11. The tool of claim 8 wherein the perimeter of said cutters is star-shaped.

12. The tool of claim 8 wherein the perimeter of said cutters is elliptical.

13. The tool of claim 8 wherein the perimeter of said cutters includes connected linear segments.

14. The tool of claim 8 wherein the perimeter of said cutters includes connected curved segments.

15. The tool of claim 1 wherein the perimeter of said cutters is irregularly shaped.

16. The tool of claim 15 wherein the perimeter of said cutters includes connected linear segments.

17. The tool of claim 15 wherein the perimeter of said cutters includes connected curved segments.

18. The tool of claim 5 wherein said aperture in said base is multi-sided and includes a keyway formed in one side, and wherein said first inserts include a key projection adapted to matingly engage said keyway, whereby the orientation of said first inserts with respect to said base will be non-uniform.

* * * * *